US006249942B1

(12) United States Patent
Schmid

(10) Patent No.: US 6,249,942 B1
(45) Date of Patent: Jun. 26, 2001

(54) MAKING ITEMS OF JEWELRY AND APPARATUS THEREFOR

(75) Inventor: Peter Schmid, Birmingham (GB)

(73) Assignee: Abbeycrest PLC, Leeds (GB)

( * ) Notice: Subject to any disclaimer, the term of this patent is extended or adjusted under 35 U.S.C. 154(b) by 0 days.

(21) Appl. No.: 09/380,428

(22) PCT Filed: Feb. 27, 1998

(86) PCT No.: PCT/GB98/00464

§ 371 Date: Dec. 6, 1999

§ 102(e) Date: Dec. 6, 1999

(87) PCT Pub. No.: WO98/37784

PCT Pub. Date: Sep. 3, 1998

(30) Foreign Application Priority Data

Mar. 1, 1997 (GB) ..... 9704302

(51) Int. Cl.[7] ..... B21D 53/40

(52) U.S. Cl. ..... 29/11; 29/896.4

(58) Field of Search ..... 29/11, 896.4; 63/19

(56) References Cited

U.S. PATENT DOCUMENTS 3,618,338 11/1971 Sauer .

FOREIGN PATENT DOCUMENTS 0 540 875 A1 5/1993 (EP) .
56-009035 1/1981 (JP) .
1148685 * 4/1985 (SU) ..... 29/11

* cited by examiner

*Primary Examiner*—P. W. Echols
(74) *Attorney, Agent, or Firm*—Woodward, Emhardt, Naughton Moriarty & McNett

(57) ABSTRACT

A method and device for forming hinges between components of jewelry with the components having a tongue and a pin. A jig with a curved surface supports the two components while a die is moved into engagement with the tongue and pin to force them against the jig causing the tongue to curl around the pin.

7 Claims, 6 Drawing Sheets

CROSS-SECTION B-B

CROSS-SECTION A-A

CROSS-SECTION X-X 62
66
64
60
70
68
76
74
78
72
80
82
52
40
30(36)
32(38)
100
96
84
94
92
86
99
88
98
90

MAKING ITEMS OF JEWELRY AND APPARATUS THEREFOR

This invention relates to the making of items of jewellery and apparatus therefor. The items are of a nature comprising two components which are hinged together so as to be movable between open and closed positions. A specific item to which the invention relates is what is known as a locket, which comprises two components or halves adapted to contain a keepsake or keepsakes such as photographs, locks of hair and so on, the halves being movable between closed and open positions. Lockets are usually worn around the neck, being suspended therefrom by means of a suitable jewellery chain, the locket having an attachment loop for connection of the locket to the chain.

Although the invention has particular application to lockets, it is to be mentioned that it can be applied to other items of jewellery, and included within this expression are items such as watch cases, compacts, and the like.

The invention applies to items of jewellery wherein there are two endless hoops or rims which may be of any shape e.g. round, circular, triangular, heart shaped and so on and which when in the open position lie side by side and symmetrically arranged, the hinge being where the two rims touch, and when the rims are in the closed position, they lie in superimposed relationship. An item of jewellery to which the invention relates may also comprise simply a pair of rims hinged together said rims being for example adapted to contain a photograph. The item may comprise one rim and a rim and shell.

Lockets are of course well known and are in extensive use, and whilst lockets of the known form vary in quality depending upon the skill of the manufacturer and the material used, generally speaking the known lockets comprise a number of components which have to be connected to produce the final locket. These components comprise a pair of locket shells each of which is dished to form a receiving cavity, a pair of the said rims which are soldered to the shells, tubular hinge sleeves which are soldered to the rims and/or shells, a hinge pin which is threaded into the hinge sleeves on the respective locket halves, and a locket clasp which may be in one part or two parts soldered to the locket halves.

The manner of assembly and manufacture is expensive and time consuming, and great care must be taken if a locket of quality is to be produced. Despite the shortcomings of the known construction, lockets have been produced only in this way for many years.

The invention the subject of our European Patent Application No. 0540875 an item of jewellery, involving a method of production which, as applied specifically to lockets, will enable a quicker and less expensive production of lockets whilst retaining the required production quality.

In accordance with that invention, an item of jewellery comprising or including a pair of the said rims is produced by manufacturing the rims as blanks provided respectively with an integral hinge pin on the one hand and an integral hinge tongue on the other hand, said tongue being wrapped around the integral hinge pin in order to connect the rims hingedly together.

That invention provides an effective and efficient method of forming a hinge between jewellery item rims, and this is particularly applicable to the production of lockets.

The rim blanks preferably are produced from sheet material by high precision manufacturing machines, which typically will be high precision stamping machines, and the rims may be produced in the metal which traditionally is used for lockets. This metal may obviously range from precious metal such as gold to inexpensive metallic alloy.

When that invention is applied to a locket, the said rims preferably are soldered to respective and conventional locket shells.

In order to facilitate assembly and assist registration of the shell and to provide for quality manufacture, the integral hinge pin may be offset relative to the rim and formed between a pair of shoulders defined in the appropriate rim so that the integral hinge tongue is limited in its axial movement lengthwise of the hinge pin. Also at the other side of the rim is formed a recess again between shoulders for the receipt of the clasp tongue. With these constraining shoulders, when the locket is moved to the closed position, the respective shells will be in accurate register providing a high quality manufacturing characteristic to the finished product.

It is described in that application that to assemble a locket in accordance with that invention, the rims respectively are attached to the shells in register therewith, by the conventional method of soldering, and the integral tongue on the other rim is passed behind the hinge pin between the hinge pin and the shell, following which the tongue is wrapped round the hinge pin by simple bending of same, manually, so that the bent tongue forms a hinge sleeve.

When it comes to assembling large quantities of the items of jewellery according to the said invention, by the hand assembly method described above, the work becomes tedious, and somewhat slow, and accordingly it is an object of this invention to provide a method of assembly of the items of jewellery of which specific examples are constructed according to the said invention, which method is much quicker and more efficient than the manual method as described above.

According to the invention there is provided a method of assembling an item of jewellery, which comprises two components to be hinged together, and wherein one component has a tongue which is pre-curled and is located around a hinge pin of the other component, and the components, thus assembled, or whilst they are being assembled, being placed upon a Jig presenting two surfaces which lie at an angle to each other and respectively support the components so that the tongue and hinge lie in alignment with a curved forming groove in the vicinity of the meeting zone of the surfaces, and a forming tool is moved into that zone in a direction bisecting the said angle, completing the curling of the tongue in the forming groove and forming it to the required degree around the hinge pin to complete the hinge.

The components preferably each comprise a rim having a shell secured thereto, and the tongue is formed on the rim of one of the components, and the hinge pin is formed as part of the rim of the other component, there being a gap between the hinge pin and the shell of that component into which the pre-curled tongue can be fed.

Also according to the invention there is provided apparatus for forming an item of jewellery which comprises two components to be hinged together, and wherein one component has a tongue which is pre-curled and is located around a hinge pin of the other component, the apparatus comprising a jig presenting two surfaces which lie at an angle to each other and respectively are for supporting the components so that the tongue and hinge lie in alignment with a curved forming groove of the apparatus lying in the vicinity of the meeting zone of the surfaces, and a forming, tool adapted to be moved into that zone in a direction bisecting the said angle, to complete the curling of the tongue in the forming groove to form it to the required degree around the hinge pin to complete the hinge.

The exterior surfaces of the shells may be embossed and/or decorated in any desired manner, or as with many traditional lockets, may be left plain.

An embodiment of the invention will now be described, also with reference to the manufacture of a known locket, by referring to the accompanying drawings, wherein.

Figure 2:
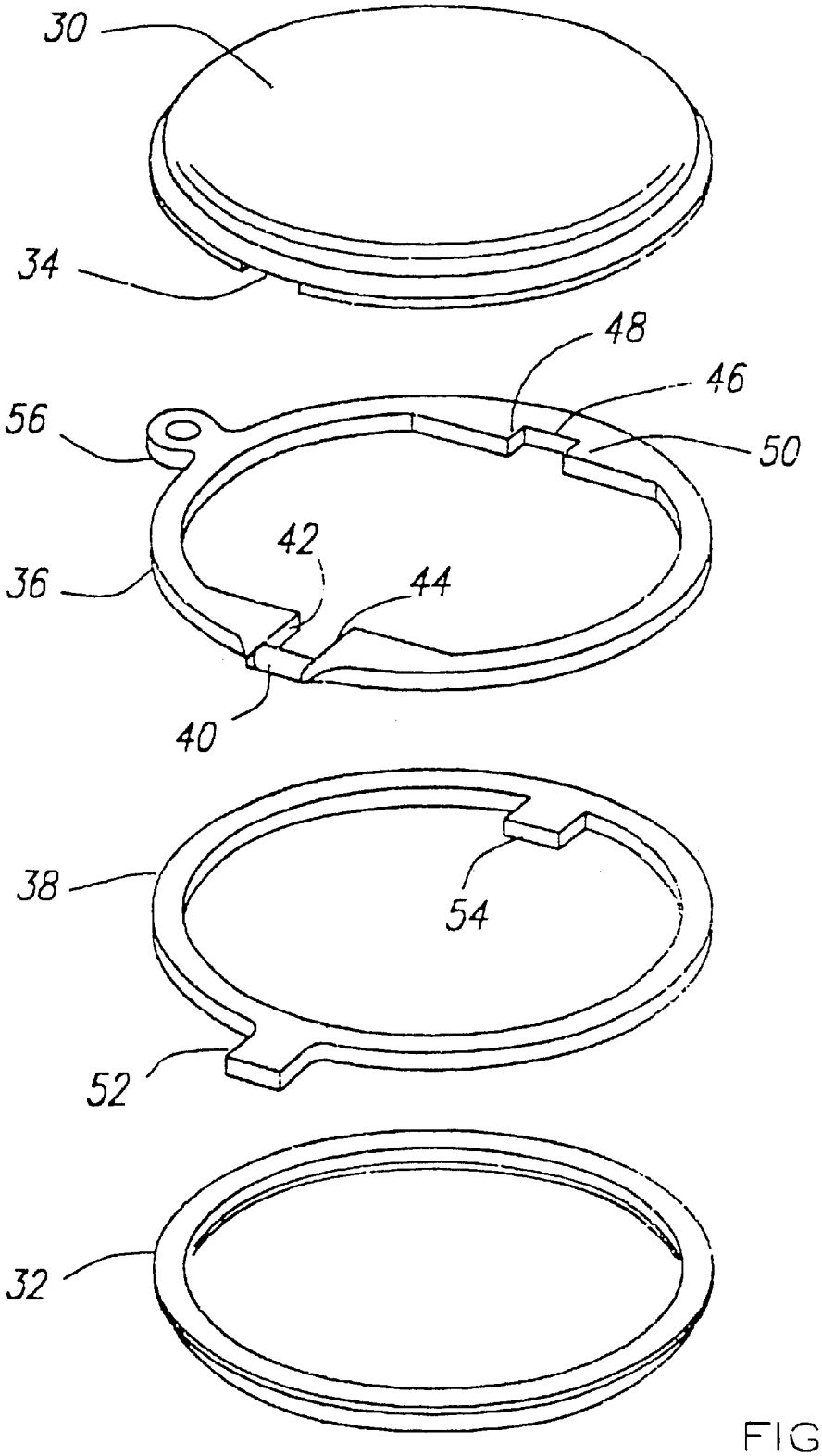
FIG. 2 is a view similar to FIG. 1, but showing the components of a locket according to the invention of said European Patent Appication No.0540875.
Figure 4:
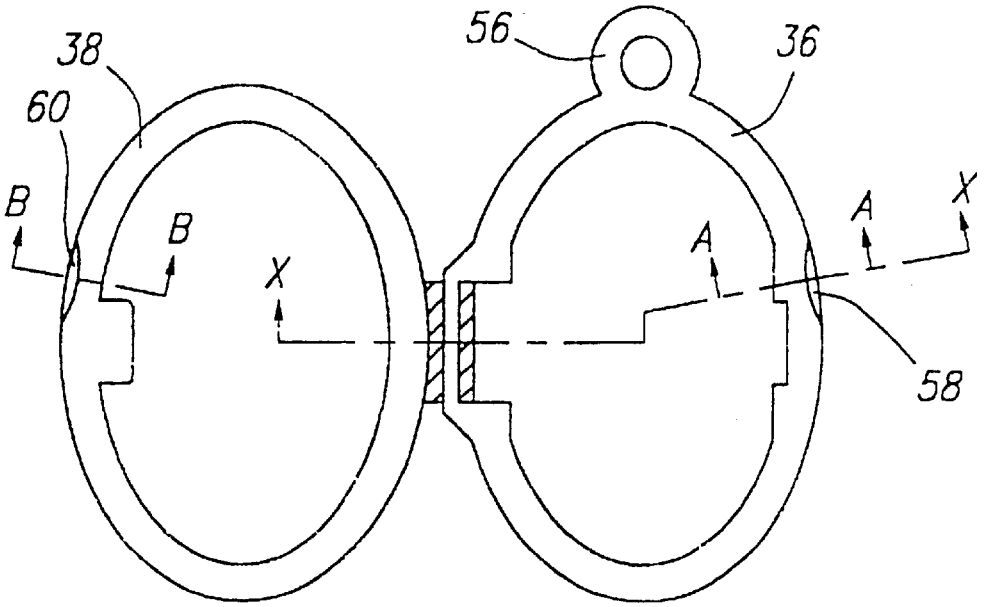
Figure 5:
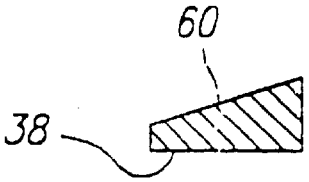
Figure 6:
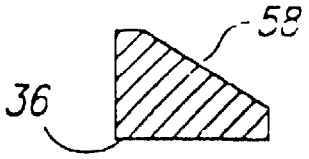
Figure 7:
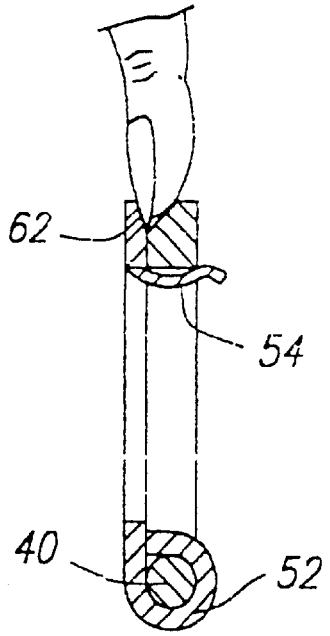
Figure 8:
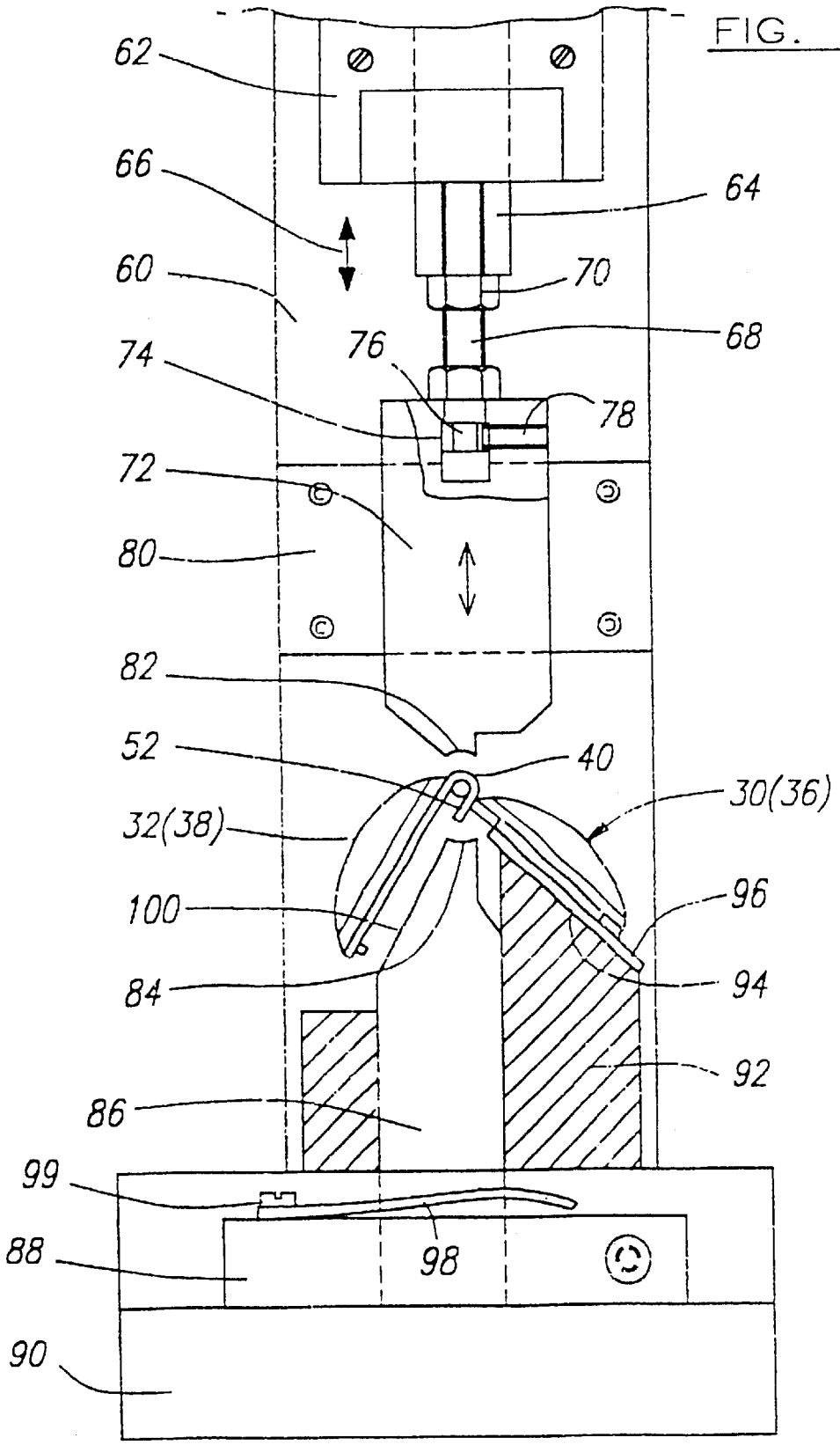
Figure 9:
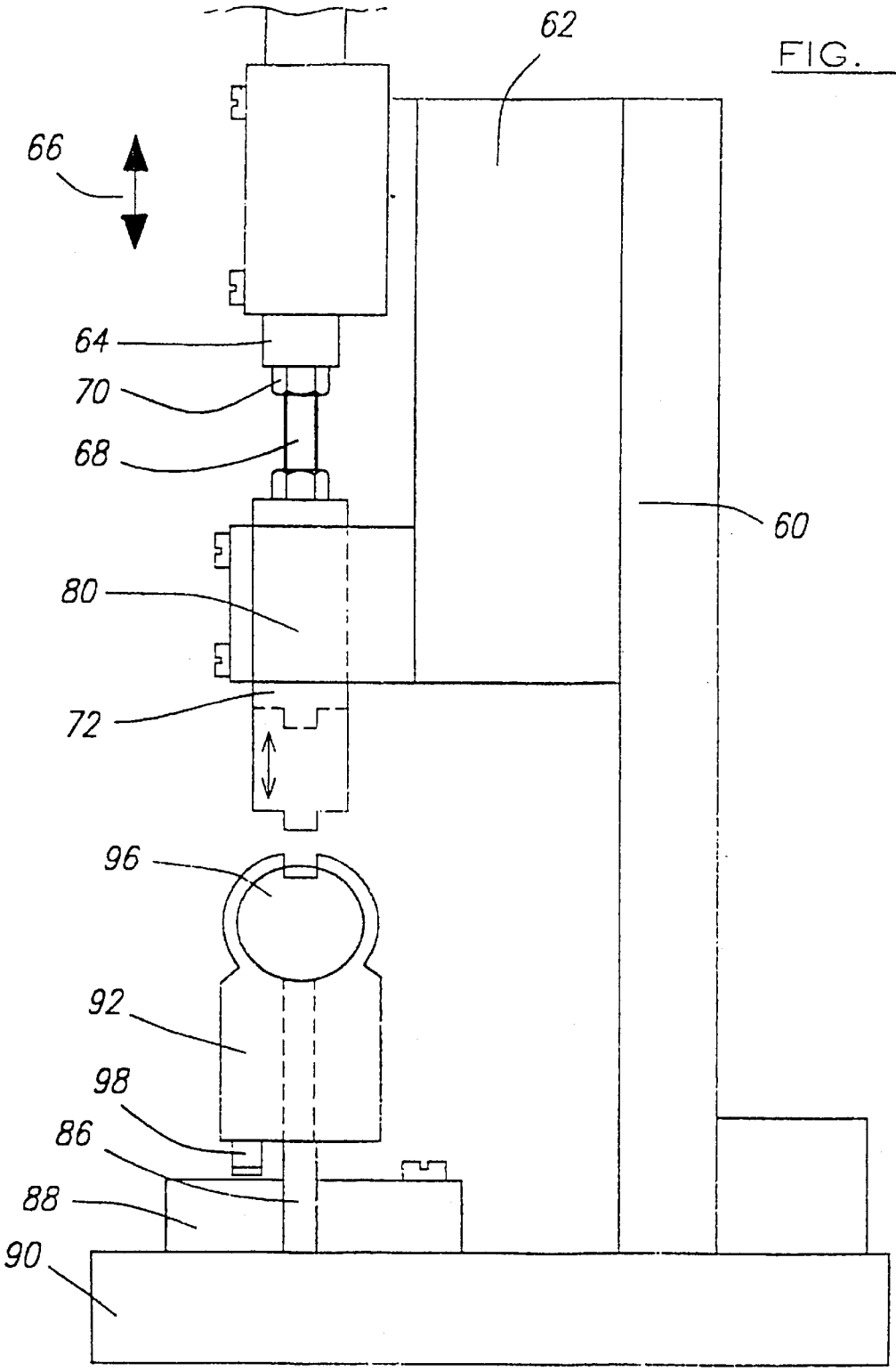

FIGS. 3A to 3D comprise a series of perspective views showing how the hinge between the rims shown in FIG. 2 is formed;

FIG. 4 is a plan view showing the rims of Fig. 2 when hinged together and in the open position;

FIGS. 5 and 6 are detailed sectional views taken on the lines A/A and B/B in FIG. 4;

FIG. 7 is a sectional elevation of the rims of FIG. 4 when in the closed position and taken on the section line X/X in FIG. 4;

FIG. 8 is a front view of a machine for putting the halves of the locket of FIG. 2 together; and FIG. 9 is a side view of the machine of FIG. 9.

Figure 1:
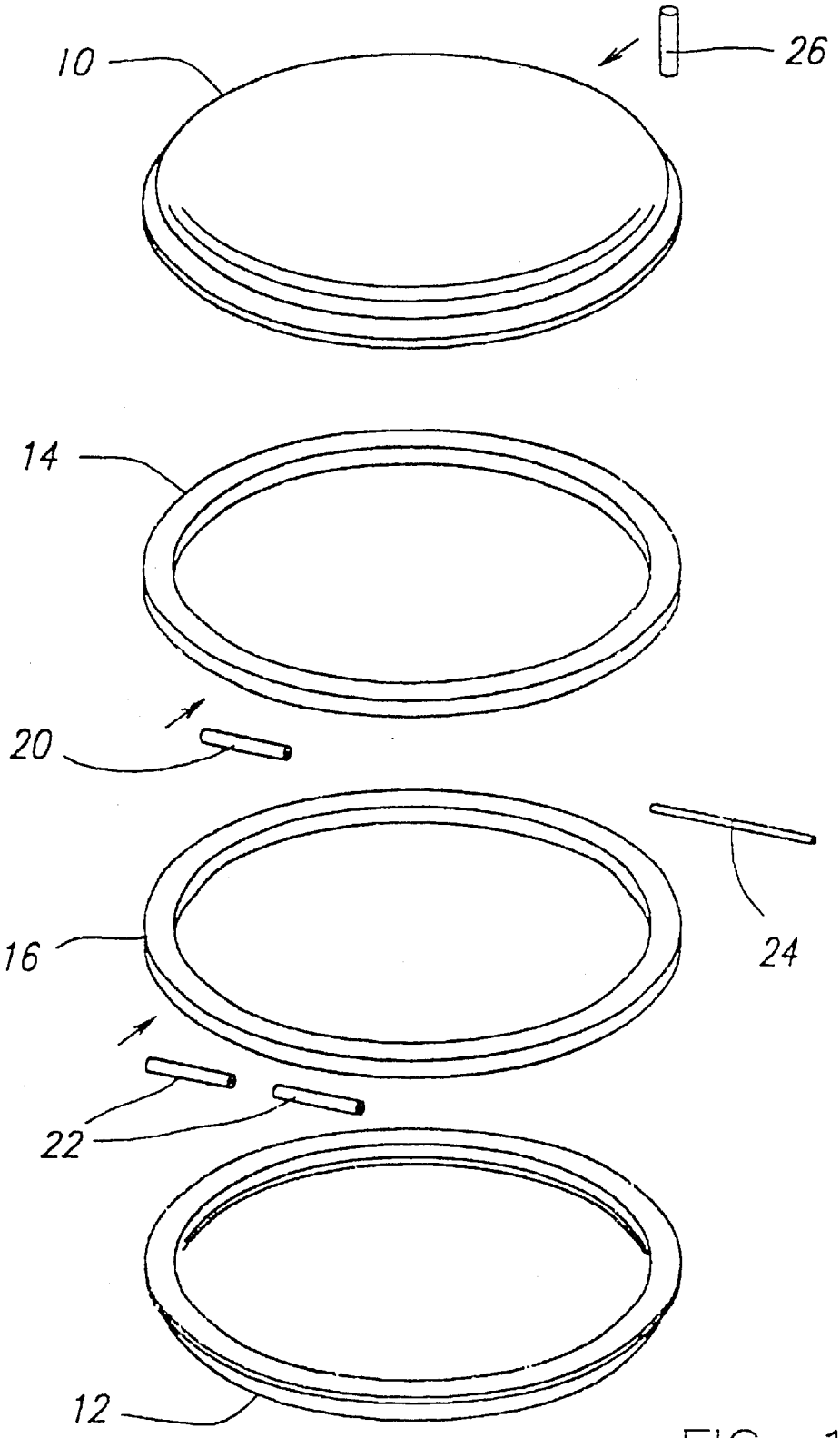
FIG. 1 is an exploded perspective view of the components of a well known locket.

Referring to the drawings, in FIG. 1, the components of a well-known conventional locket are shown and will be seen to comprise a pair of dished shells 10 and 12 of essentially similar configuration. The shells in this example are elliptical, but they could be of any appropriate shape.

Additionally, the locket includes a pair of rings 14 and 16 which in use are soldered to the edges of the shells 10 and 12, the rings being of the same size as the shells 10 and 12.

The thus connected rims and shells form the locket halves, and the halves are hinged together by a hinge assembly created by the connection of hinge sleeve 20 (connected to locket half 10, 14) and hinge sleeves 22 (connected to locket half 12, 16). To form the hinge the sleeves 20 and 22 are aligned, and a hinge pin 24 is inserted in the aligned sleeves to complete the hinge connection of the locket halves.

Finally, a locket clasp 26 is soldered to the locket half 10, 14 and clasp 26 is adapted to engage an appropriate formation on the locket half 12, 16 to keep the locket in closed condition.

Although not shown in FIG. 1, the rims 14 and 16 may be chamfered or cut away in order to provide a thumb nail or finger nail slot in which a nail can be inserted in order to open the locket against the retaining force of the clasp 26.

Also, one of the rims 14 and 26 may be provided with an attachment ring by which the locket may be suspended from the user's neck by a conventional locket chain.

The problem with the locket assembly of FIG. 1 is that it includes many parts which have to be carefully connected together if a locket of quality is to result. Its manufacture is therefore time consuming and relatively costly, and the invention, the subject of said European Application seeks to provide a hinged locket which can be manufactured quicker and less expensively than the conventional locket and an example of a hinged locket is shown in FIGS. 2 to 7.

Referring to FIG. 2 which illustrates the parts of the new hinge locket in exploded perspective view, again the locket is provided with a pair of similar shells 30 and 32, the shell 30 however having a cut out 34 for a purpose to be explained.

The locket also has a pair of endless rings or rims 36 and 38 but these rims are formed as stampings and are produced by high precision manufacturing machinery, so that the rims 36 and 38 have extra formations whereby the need to attach separate hinge sleeves and pins as described in relation to the FIG. 1 arrangement is avoided.

In the case of rim 36 which is for attachment to shell 30 by soldering, the ring has an integral hinge pin 40 formed with a circular cross section and formed as an integral part of the rim between a pair of limiting shoulders 42 and 44. The circular cross section can be formed during stamping or subsequently the stamping can be machined or hand ground or filed to form the pin with a circular cross section. Opposite the hinge pin 40 the rim furthermore has a recess 46 which is defined by a pair of limiting shoulders 48 and 50. The hinge pin 40 is offset relative to the elliptical line of the rim to enhance the assembly method of the present invention.

As regards the rim 38, this is provided with an integral hinge tongue 52, and diametrically opposite same is an integral clasp tongue 54 which is slightly shorter and narrower than the tongue 52.

The rim 38 is, as is conventional, soldered to the shell 32.

As also shown in FIG. 2, the rim 36 is provided with an attachment loop 56 for connection of the locket to a conventional locket chain.

In the first stage of manufacture of the locket of FIG. 2, the rims 36 and 38 are soldered to the shells 30 and 32 in conventional fashion but with the cut out 34 of shell 30 in register with the pin 40 and then the resulting locket halves of components, are connected as shown sequentially in FIGS. 3A to 3D.

Figure 3A:
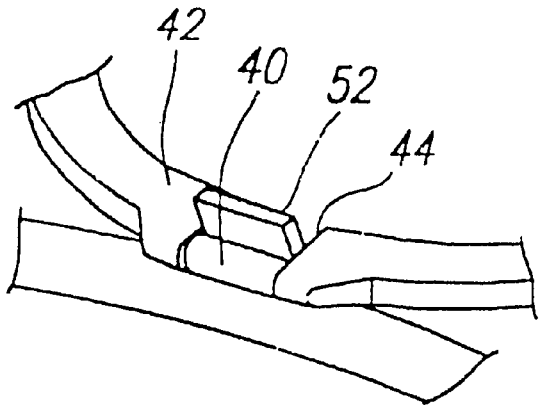

The steps involved in the assembly according to the invention will be described in more detail in relation to FIGS. 8 and 9, but referring initially to FIG. 3A to 3D, the prior manual method will be described. The locket halves are brought together in a partly open condition so that the tongue 52 is passed under the hinge pin 40 between the shoulders of 42 and 44 as shown in FIG. 3A, the cut out 34 providing clearance for this purpose and the offset of the hinge rim 40 also enabling the tongue 52 to be passed between the pin 40 and the shell 30.

Figure 3B:
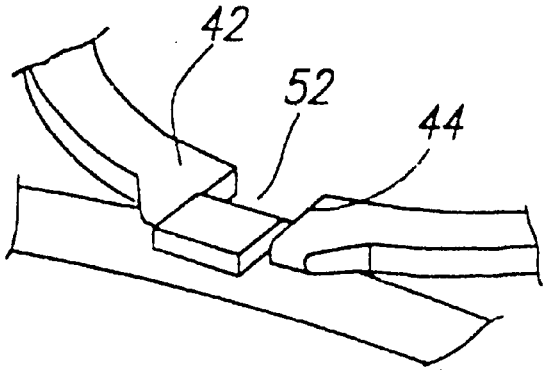
Figure 3C:
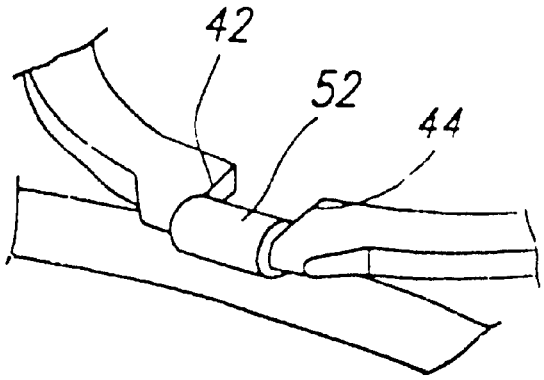
Figure 3D:
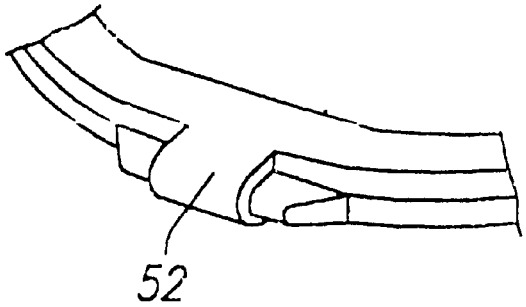

To connect the locket halves, the tongue 52 is bent manually around the hinge pin as indicated by the sequence of FIGS. 3B to 3D. The manual method is time consuming and suffers from lack of accuracy. Alternatively, the tongue 52 may have been pre-curled, but to completely form the hinge in this instance is still a meticulous and thus time consuming operation.

With the method according to this invention, forming the hinge is more accurate and quicker.

The manual bending of the tongue 52 has been done in the past by relatively unskilled labour using a suitable tool or tools but it has been found that this method is not satisfactory for a number of reasons. The resulting hinges are not sufficiently accurate, and the work is tedious, time consuming and expensive in labour costs. It will be appreciated that the tongue 52 is made of the appropriate length, and the hinge pin 40 appropriately dimensioned and positioned with the objective of having the two locket halves when connected, capable of being readily and accurately, and repeatedly without failure, hinged between the open and closed positions. FIG. 3D shows the locket rims when the locket is in the closed position. The shoulders 42 and 44 limit the extent to which the tongue 52 (having the form of a hinge sleeve) can move axially of the pin 40, and of course the accuracy of the manufacturing technique and the limitation of the tolerances is directly related to the quality of manufacture of the resulting locket.

The clasp tongue 54 is bent as shown in FIG. 7 in order to form a spring clasp which engages in the recess 46 in the closed position of the locket holding the locket halves together. Again the shoulders 48 and 50 provide a means for restraining lateral movement of the locket halves in the closed position.

FIG. 4 shows that the rims 36 and 38 are recessed or scalloped at locations 58 and 60 to provide fingernail recesses. These scallop portions come together as shown in FIG. 7 to provide a cavity 62 in which the fingernail can be located in order to force the locket halves apart against the spring action of the clasp tongue 54.

FIGS. 5 and 6 show that the rim 36 is of heavier gauge metal than the rim 38, although this is not necessary to the invention.

The hinge pin 40, the shoulders 42 and 44, the attachment loop 56 and the recess 46 are all formed during the pressing operations of rim 36, and in the case of rim 38, the clasp tongue 54 may be simultaneously formed into the catch configuration shown in FIG. 7 so that the only subsequent operation to be performed is that of bending the tongue 52 as shown in FIGS. 3A to 3C.

The features of the rims ensure a very good match of the rims and the rims can be of any required shape dictated by the nature of the product to be made or the contents to be held. Additionally, although the shells and rims are shown as being of the same shape in the examples described, it will be appreciated that this is not strictly necessary although the rim would may have to be varied if it is to accommodate a shell of a different configuration.

Referring now to FIGS. 8 and 9 which show the embodiment of the method and machine of the present invention, the hinge-closing machine shown comprises a punch and die arrangement which includes a vertical spacer block 60 which carries at the upper end a toggle clamp of which a body portion is shown at 62. The toggle clamp includes a ram 64 which by toggle action can be moved up and down vertically as indicated by arrow 66. Attached to the ram is punch adjustment screw 68 which is connected by a lock nut 70 to the ram, and at its lower end engages a movable punch block 72. Punch block 72 has a bore 74 in which the end portion of the ram is received. That end portion has a waist section 76 in which a locking grub screw 78 is engaged in order to connect the ram to the punch block 72.

The spacer block 60 carries punch guide block 80 to ensure that the block 72 moves accurately in a vertical direction.

At its lower end, the punch block 72 is provided with a curved punching surface 82 which is located opposite a complementary curved surface 84 on a stationary die 86.

The die 86 is mounted on a die holder plate 88, which is in turn mounted on a base 90.

Surrounding the die 86 is a sliding body 92 which on one side has an inclined face 94 which in turn mounts a two piece positioning plate 96 which serves to locate and position the locket halves or components on opposite sides of a vertical plane in order that the punch and die operation can take place to form the tongue 52 around the hinge pin 40 of the locket.

The sliding body 92 is adapted to be spring urged in a vertically inaccurate upward direction by a leaf spring 98 at the end of the die forming operation to be described. The leaf spring is attached to the support block by means of a screw 99.

In FIG. 8, a pre-assembled locket is shown in position in the apparatus, and it will be seen that the rear half of the locket comprising shell 30 and rim 36 is positioned on the two piece positioning plate 96, so that the hinge pin 40 of this half lies accurately between the two curved forming faces 82 and 84 and in alignment therewith. The front half of the locket made up of shell 32 and rim 38 is shown as having the tongue 52 pre-curled and wrapped or hooked around the pin 40. As a result, the two halves of the locket lie at an angle to extend to opposite sides of the vertical, with the rim sides of the halves facing downwards. The die 86 is also provided with an inclined face 100 on which the front half of the locket can rest.

With the apparatus set up as shown in FIG. 8, it is simply a matter of operating the toggle clamp which brings the die punch 72 in a vertically downwards direction to engage the pre-curled tongue 52 and to press it along with the pin 40 down onto the fixed die 86, the sliding body 92 moving in a downwards direction against the action of spring 98 during this operation. As a result, the tongue 52 is caused by the dies 82, 84 to curl completely and accurately around the pin 40 forming an accurate and freely operating hinge. When the toggle is raised, the sliding block 92 is directed upwardly by means of the leaf spring 98, and the locket can simply be removed from the machine.

In the assembling of the locket in the machine, it is preferable firstly to place the rear half of the locket in position on the two piece location plate 96, then to hook the pre-curled tongue 52 of the locket front half around the pin 40, following which the punch is lowered as described.

The provision of a sliding block 92 and a two piece location plate 96 is important to the operation of the machine and the method as during the operation, the form of the tongue 52 changes progressively and as the punch descends, the locket has to be able to move down at the same rate and at the same time to keep alignment between the tongue 52 and the hinge pin 40.

The curved surfaces or forms 82 and 84 obviously need to be of accurate profile.

The upward sliding movement of the sliding block 92 upon completion of the operation lifts the locket clear of the die 86 enabling easy removal.

The method and machine of the invention enable fast and accurate assembly of the locket halves.

The invention can be applied to any components of any item of jewellery wherein the components respectively have a tongue and a hinge pin to be connected to form a hinge.

Additionally, although the die 82 slides in a direction which bisects the angle set by the support surfaces 94 and 100, it is not the case that the angle should be exactly bisected equally, but that the direction of sliding of the die 82 should lie between said surfaces.

Also, although preferred, it is not essential that the direction of movement of the dies be vertical.

What is claimed is:

1. A method of assembling an item of jewelry, which comprises two components to be hinged together, and wherein one component has a tongue which is pre-curled and is located around a hinge pin of the other component, and the components, thus assembled, or whilst they are being assembled, being placed upon a jig presenting two surfaces which lie at an angle to each other and respectively support the components so that the tongue and hinge lie in alignment with a curved forming groove in the vicinity of the meeting zone of the surfaces, and a forming tool is moved into that zone in the direction bisecting the said angle, completing the curling of the tongue in the forming groove and forming it to the required degree around the hinge pin to complete the hinge.

2. The method according to claim 1, wherein one of the surfaces is defined by a slide body which is displaced by the moving forming tool against spring action, allowing the tongue and pin to move along with the body as the tongue is fully curled round the pin.

3. Apparatus for forming an item of jewelry which comprises two components to be hinged together, and wherein one component has a tongue which is pre-curled and is located around a hinge pin of the other component, the apparatus comprising a jig presenting two surfaces which lie at an angle to each other and respectively are for supporting the components resting thereon so that the tongue and hinge lie in alignment with a curved forming groove of the apparatus lying in the vicinity of the meeting zone of the surfaces with the curved forming groove located on the jig, and a forming tool adapted to be moved into that zone in a direction bisecting the said angle, to complete the curling of the tongue in the forming groove to form it to the required degree around the hinge pin (40) to complete the hinge.

4. Apparatus according to claim 3, wherein one of the surfaces is defined by a spring loaded, slide body which is displaceable by the moving forming tool against spring action, allowing the tongue and pin to move along with the body as the tongue is fully curled round the pin located in the forming groove on the jig.

5. An apparatus for forming a tongue of a first component around a hinge pin of a second component to hinge the first component to the second component comprising:

a frame;

a jig mounted to said frame, said jig including a first supporting surface and a second supporting surface upon which respectively said first component and said second component are restable, said first supporting surface and said second supporting surface extend convergingly one surface being movable with respect to said frame and form a meeting zone, said jig further including an outwardly opening curved forming groove located in said meeting zone of said first supporting surface and said second supporting surface to receive a tongue of a first component and a hinge pin of a second component; and, a forming die movably mounted to said frame, said die including a forming surface facing said outwardly opening curved forming groove, said forming die and said jig forcing said forming surface and said curved forming groove together to bend the tongue around the hinge pin.

6.The apparatus of claim 5 wherein:

said forming surface is curved and positioned oppositely of and opening toward said curved forming groove when said jig and die are moved together.

7. The apparatus of claim 6 wherein:

said jig includes a first element with said first supporting surface and said curved forming groove formed thereon, said jig includes a second element surrounding said first element with said second supporting surface on said second element, said second element is spring biased upwardly but is movable downwardly to allow said tongue to be forced around said hinge pin by said forming surface moving downwardly toward said curved formed groove.

* * * * *